US006851339B2

(12) United States Patent
Casel

(10) Patent No.: US 6,851,339 B2
(45) Date of Patent: Feb. 8, 2005

(54) HAND GRIP OF A SCREWDRIVER

(75) Inventor: André Casel, Wuppertal (DE)

(73) Assignee: Robert Schröder GmbH & Co. KG, Wuppertal (DE)

( * ) Notice: Subject to any disclaimer, the term of this patent is extended or adjusted under 35 U.S.C. 154(b) by 0 days.

(21) Appl. No.: 09/990,873

(22) Filed: Nov. 16, 2001

(65) Prior Publication Data

US 2003/0226430 A1 Dec. 11, 2003

(30) Foreign Application Priority Data

Nov. 17, 2000 (DE) ..... 100 57 328

(51) Int. Cl.[7] ..... B25B 23/16
(52) U.S. Cl. ..... 81/177.4; 81/490; 81/438
(58) Field of Search ..... 81/490, 177.4, 81/438–439

(56) References Cited

U.S. PATENT DOCUMENTS 5,927,162 A * 7/1999 Huang ..... 81/177.8
6,293,173 B1 * 9/2001 Rowlay ..... 81/490

FOREIGN PATENT DOCUMENTS

| | | |
|---|---|---|
| EP | 0 312 775 | 4/1989 |
| GB | 2 340 199 | 2/2000 |

* cited by examiner

*Primary Examiner*—Debra S. Meislin
(74) *Attorney, Agent, or Firm*—Gudrun E. Huckett

(57) ABSTRACT

A hand grip of a screwdriver for bits has a grip member having a first end and a second end. The first end has a tool holder for the bits. The second end has a stationary core with a round magazine having bit compartments extending in the longitudinal direction of the grip member and a closure device rotatable relative to the round magazine. The closure device has a sleeve providing an ergonomic outer shape of the second end of the grip member. The sleeve is rotatably supported on the stationary core and has a longitudinal access opening which passes externally across the bit compartments when the sleeve is rotated relative to the stationary core. The access opening can be aligned with the bit compartments for removal or insertion of the bit. The sleeve has a longitudinal length such that the upper end and the lower end form a closed ring, respectively.

13 Claims, 2 Drawing Sheets

HAND GRIP OF A SCREWDRIVER

BACKGROUND OF THE INVENTION

1. Field of the Invention

The invention relates to of a hand grip of a screwdriver for bits, wherein the hand grip has one end provided with a tool holder and comprises another end opposite the tool holder. A round magazine is located at the stationary core of the hand grip. The round magazine is comprised of bit compartments oriented in the longitudinal direction of the hand grip and positioned adjacent to one another and designed for receiving bits. A closing device with an access opening is provided and movable relative to the round magazine, wherein the access opening can be aligned with the bit compartments upon relative movement to the round magazine.

2. Description of the Related Art

The present invention is based on a hand grip of the type found on screwdrivers which, when being used, come to rest with one end on the ball of the thumb of the user so that the thumb and fingers grip the periphery of the hand grip for introducing torque into the screwdriver while the ball of the thumb provides an axial force that is introduced into the hand grip. This end of the hand grip is also referred to as the "upper end" of the hand grip. The opposite end has connected thereto a tool holder which is connected fixedly with the core of the hand grip and is designed to receive the bits. This end of the hand grip is also referred to as the "lower end" of the hand grip. In analogy, the closing device has a "lower edge" facing the tool holder and an "upper edge" facing away from the tool holder.

Such a hand grip is known, for example, from GB 98 168 78.4.

In this hand grip, the round magazine contained within the stationary core is arranged at the lower end where the tool holder adjoins. The bits contained therein are secured by a partial ring which has a removal notch and which is rotatable relative to the round magazine so that the notch, as needed, can be aligned with one of the bit compartments.

The use of such a hand grip as a force-introducing tool is problematic because the rotatable closing device, in certain situations, can be rotated accidentally by the fingers when a corresponding torque must be introduced into the hand grip.

Moreover, in this configuration the rotatable closing device covers only a part of the entire axial length of each bit so that the bit to be removed is easily recognizable; however, this entails also the risk of the closing device becoming jammed.

On the other hand, the grip according to EP 0 312 775 A1 enables identifying of the bits contained in the round magazine from the exterior by means of a transparent sleeve. The round magazine is located at the upper end of the hand grip and is covered by a lid integrated therein.

For removing the bit, the lid is provided with an axial bore which can be aligned as needed with one of the bit compartments.

Since the lid is rotatable relative to the hand grip, this configuration also entails the problem of the lid also being rotated when a great torque is to be transmitted by the hand grip into the tool holder.

Moreover, the removal of the bits contained in the round magazine is a problem because each bit can be recognized practically only via the axial bore provided in the lid, unless the hand grip is made of a transparent material.

SUMMARY OF THE INVENTION

It is an object of the present invention to improve the known hand grip such that the bits which are contained in the round magazine can be more easily recognized in the removal position and that, at the same time, the risk of jamming of the rotatable locking device is reduced.

In accordance with the present invention, this is achieved in that the round magazine is arranged at the end of the hand grip facing away from the tool holder and that the closing device is a sleeve which is ergonomically matched to the outer contour of this end of the hand grip, wherein the sleeve is rotatably supported on the stationary core of the hand grip and has an access opening oriented in the longitudinal direction of the bit compartments, with which it passes across the bit compartments externally upon relative rotation, and in that the rotatable sleeve extends in the longitudinal direction of the bit compartments to such an extent that it forms a closed ring, respectively, in the area of the edge facing away from the tool holder as well as in the area facing the tool holder.

The invention provides the advantage that the rotatable closing device, when rotated into the removal position or access position, does not cover the inserted bits and the bit to be removed is therefore completely visible, while a pressure-stable and rotationally stable sleeve is provided which contributes significantly to torque loading of the hand grip.

This advantage is achieved in that the closing device conforms ergonomically to the outer contour of the upper grip end. In principle, the sleeve is an annular elongate sleeve which is closed in the area of the upper and lower edges. The annular closed areas (closed rings) are guided on corresponding counter contours of the stationary core of the hand grip so that high pressures can be exerted onto the closing device without there being the risk of destruction.

Advantageously, the provided access opening has at least such a length that it matches the length of the bit contained behind it in the round magazine so that the bit can be easily rolled out of the pocket of the bit compartment of the round magazine.

In this connection, the size of the access opening enables a precise evaluation of the bit to be removed with respect to the current application before the bit is actually removed.

In addition, it can be provided that the outer contour of the sleeve is flush with the outer contours of the adjoining parts of the hand grip. This is shown in the disclosed embodiments.

DESCRIPTION OF THE PREFERRED EMBODIMENTS

Figure 1:
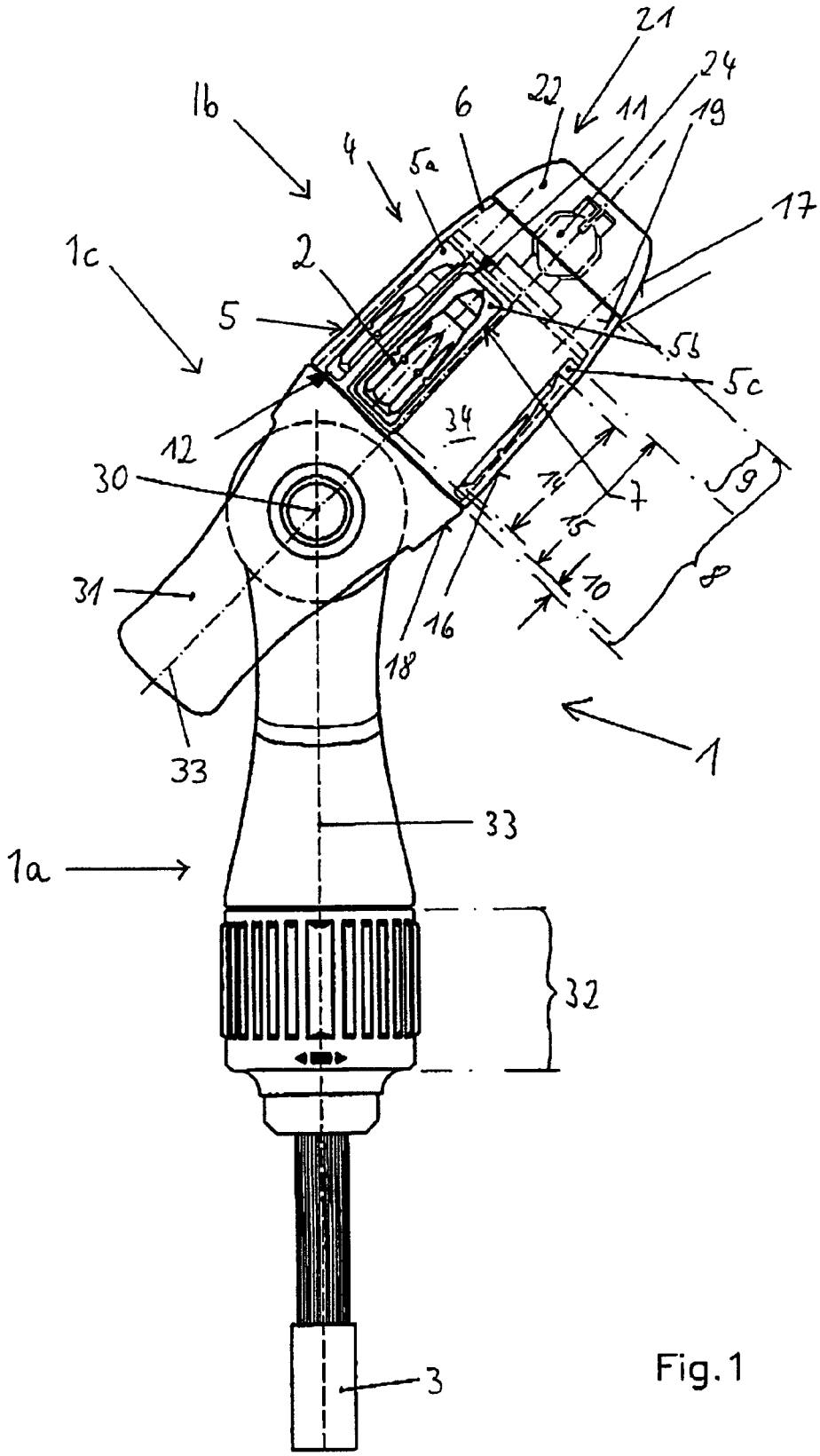
FIG. 1 is a complete illustration of an embodiment of the invention showing the folding hand grip in the pivoted position.
Figure 2:
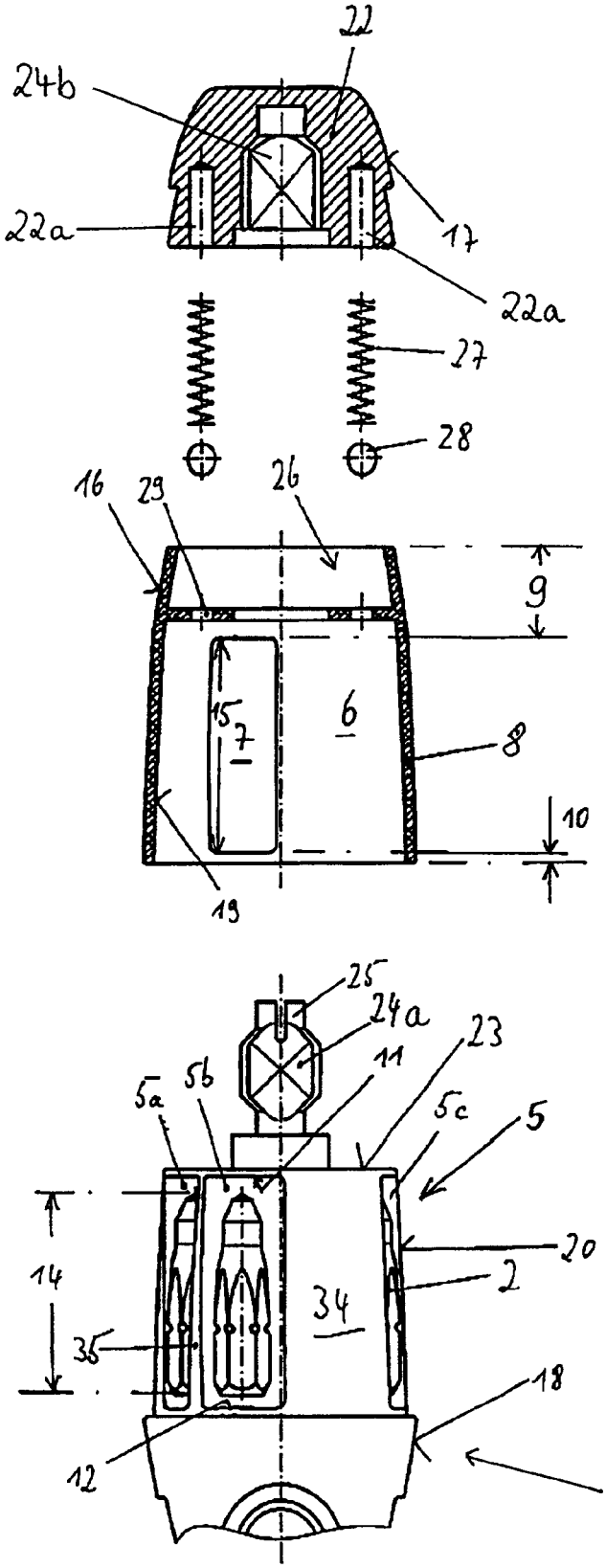
FIG. 2 is a detail view of the upper end of the hand grip of FIG. 1.

The following description relates to all Figures unless indicated otherwise.

The Figures show a hand grip 1 of a screwdriver for bits 2, comprising a tool holder 3 at the lower end 1*a* of the grip member and a stationary core 4 at the upper end 1*b* of the grip member provided with a round magazine 5 comprised of bit compartments 5*a*, 5*b*, 5*c* extending in the longitudinal direction or parallel to the longitudinal axis 33 of the hand grip 1 and arranged adjacent to one another. The bit compartments 5*a*–5*c* are configured to receive bits 2. The hand grip 1 further comprises a closing device 6 with access opening 7 which is rotatable relative to the round magazine 5. When the closing device 6 is rotated relative to the round magazine 5, the access opening 7 of the closing device 6 can be brought into an aligned access position with the bit compartments 5*a*–5*c*. It is important in this connection that the closing device 6 is a sleeve 8 which is ergonomically adjusted to the outer contour of the upper grip end, i.e., it provides an ergonomic gripping action. The sleeve 8 extends in the longitudinal direction (longitudinal axis 33) to such an extent that, on the one hand, it forms closed rings in the area of the upper edge 11 and the lower edge 12 of the bit compartments 5*a*–5*c* and, on the other hand, has an access opening 7 between the upper edge 11 and the lower edge 12 of the bit compartments 5*a*–5*c* which is oriented in the longitudinal direction (defined by the axis 33) of the bit compartments 5*a*–5*c*. When the closing device 6 is rotated relative to the bit compartments 5*a*–5*c*, the access opening 7 is moved externally across the compartments 5*a*–5*c* of the round magazine 5.

According to this configuration, the rotatable sleeve 8 is penetrated longitudinally to form the access opening 7 while the sleeve 8 forms closed rings in the area of its upper end 9 and its lower end 10.

In this way, a relatively pressure-stable configuration results which can be simply slipped onto the top portion of the hand grip 1 because the top portion of such hand grips is conventionally either cone-shaped or tapers ergonomically in other ways so as to be easily gripped.

Moreover, the outer dimensions of the round magazine 5 are selected such that the rotatable sleeve 8 rests and moves in close contact with the stationary core 4 of the grip member so that the sleeve 8 itself practically must not withstand any pressure force.

The individual bit compartments 5*a*–5*c* of the round magazine 5 have an intermediate position matching the access opening 7, and the access opening 7 can be aligned with this intermediate position. In this intermediate position none of the bit compartments 5*a*–5*c* is overlapped by the access opening 7; instead, the access opening 7 is reliably closed by the wall 34 positioned radially inwardly behind it.

Moreover, the Figures show that the access opening 7 has at least such a length 15 that the length 14 of the bits 2 contained in the bit compartments 5*a*–5*c* is matched.

The length 15 of the access opening 7 can also be somewhat smaller than the length of the bit compartments 5*a*–5*c* as long as the bits 2 contained therein can be simply removed by falling through the access opening 7.

For obtaining a user-friendly outer contour of the grip member, the outer contour 16 of the upper and lower ends 9, 10 of the sleeve 8 should be flush with the respective outer contour 17, 18 of the adjoining parts of the grip member of the hand grip 1.

This has the advantage that even when using the tool professionally such hand grips can be used over an extended period of time without causing fatigue because the user's hand can comfortably hold the hand grip.

In addition, the Figures show that the inner contour 19 of the sleeve 8 in the area of its upper end 9 and its lower end 10 as well as within the intermediately positioned area is guided for its rotation by the surrounding envelope (contour) 20 of the round magazine 5 which is a unitary part of the stationary core 4 of the hand grip 1.

The inner contour 19 of the sleeve 8 glides thus across the greatest diameter of the grip member in the area where the bit compartments 5*a*–5*c* are positioned and is supported in a pressure-stable way by the longitudinal ribs 35 (defining the contour or envelope 20) provided between the compartments 5*a*–5*c*. Because of this, the sleeve 8 can be manufactured of an inexpensive plastic material without there being the risk of breaking when a great force is introduced.

In addition, the Figures show that the upper end 9 of the sleeve 8 is positioned at a short distance below the upper end face 21 of the hand grip 1 and that the sleeve 8 is secured by an end member 22 which is anchored stationarily on the upper end of the stationary core 4 of the hand grip 1.

In the present case, the end member 22 is a cover which is anchored in the interior of the sleeve 8 while the end member 22 itself is fixedly connected with the core 4 of the hand grip 1.

In this way, a pressure-stable stop 23 between the end member 22 and the core 4 of the hand grip 1 supporting the bit compartments 5*a*–5*c* is provided. The pressure-stable stop 23 has primarily the purpose of receiving the pressing forces exerted by the ball of the thumb during the screwing action and to introduce them as axial forces into the hand grip 1.

Moreover, the end member 22 is fixedly secured relative to the grip member of hand grip 1 so that is does not rotate relative to the grip member. For this purpose, the hand grip 1 has a polygonal pin 24*a* at the upper end of the stationary core 4 which interacts with a receptacle 24*b* in the end member 22 as a rotational securing means 24 relative to the end member 22 placed thereon. In addition, a snap-on connector 25 can be provided in order to fixedly mount the end member 22 on the hand grip 1.

Additionally, the sleeve 8 has relative to the stationary core 4 a position lock 26 whose locking positions coincide with the access positions for the bits 2 contained in the bit compartments 5*a*–5*c*.

The position lock is realized in this connection by pairs of springs 27 and balls 28. A spiral spring 27 is arranged in a longitudinal bore 22*a* of the end member 22. At the head of the spiral spring 27 a ball 28 is positioned which runs on a corresponding circle on the inner circumference of the sleeve 8 when the latter (8) is rotated for the purpose of removing the bits 2.

On the aforementioned circle, corresponding catch openings 29 are provided. They (29) are positioned such that they are engaged by the spring-loaded ball 28 when the access opening 7 is aligned with one of the bit compartments 5*a*–5*c* or the wall 34.

In order to be able to identify the bits 2 easily even when the sleeve 8 is in a rotated position 2 relative to the bit compartments 5*a*–5*c*, it is additionally suggested according to the invention that the sleeve 8 be made of a transparent plastic material. Such plastic material is to include also color-coordinated transparent materials, for example, in order to be able to present such hand grips in the company colors for the purpose of furthering corporate identity.

In addition to this, FIG. 1 shows an optional embodiment of the invention in which the hand grip 1 can be folded by means of a pivot joint 1*c* (pivot axis 30) arranged below the lower edge of the sleeve 8. This pivot axis 30 extends transversely to the longitudinal axis 33 of the hand grip 1.

This measure can be beneficial for introducing greater torque because the folded upper end 1*b* in the pivoted position provides an improved torque introduction in comparison to an axial hand grip (the hand grip being positioned in the extended straight or aligned-position).

Additionally, extensions 31 can be provided on the upper end 1*b* which extend beyond the pivot axis 30. The extensions 31 are positioned opposite one another to the right and to the left of the lower end 1*a* and define a spacing therebetween to allow the user of the screwdriver to place the thumb therein when the upper end 1*b* is in the pivoted position (FIG. 1), thereby enabling the user to introduce even higher torque.

A further modification of the invention resides in that the tool holder 3 can be driven by of ratchet mechanism 32, provided on the lower end 1*a*, relative to the hand grip 1, for example, in order to be able to employ the tool also in areas that are difficult to access.

As a result of the end member 22 being secured on the core 4 against rotation relative to the core 4, great torques can thus be introduced into the hand grip 1, even under great force expenditure in the case of a seized screw or the like because of the pressure-resistant stop 23. At the least, the rotational securing means 24 prevents rotation of the end member 22 when using the tool so that great torque, resulting from the ball of the thumb, can be exerted onto the bits 2 inserted into the tool holder 3 via the hand grip 1.

Since the closing device 6 does not extend all the way up to the upper end face 21 of the hand grip but ends at a distance thereto, as shown in FIG. 1, it is not loaded by the user's hand introducing torque during normal tool use so that practically the entire manual force can be transformed into torque.

While specific embodiments of the invention have been shown and described in detail to illustrate the inventive principles, it will be understood that the invention may be embodied otherwise without departing from such principles.

What is claimed is:

1. A hand grip (1) of a screwdriver for bits (2), the hand grip (1) comprising:

a grip member having a first end (1*a*) and a second end (1*b*) opposite the first end (1*a*);

the first end (1*a*) having a tool holder (3) configured to engage the bits (2);

the second end (1*b*) having a stationary core (4) with a round magazine (5) comprising bit compartments (5*a*–5*c*) configured to store the bits (2), wherein the bit compartments (5*a*–5*c*) extend in a direction of the longitudinal axis (33) of the second end (1*b*) of the grip member and are positioned adjacent to one another;

the second end (1*b*) having a closure device (6) configured to rotate relative to the stationary round magazine (5);

the closure device (6) comprising a sleeve (8) configured to provide an ergonomic outer shape of the second end (1*b*) of the grip member, wherein the sleeve (8) has an upper end (9) remote from the tool holder (3) and a lower end (10) proximal to the tool holder (3);

wherein the sleeve (8) is rotatably supported on the stationary core (4) and has an access opening (7) extending in the direction of the longitudinal axis (33);

wherein the access opening (7) passes externally across the bit compartments (5*a*–5*c*) when the sleeve (8) is rotated relative to the stationary core (4);

wherein the access opening (7) is configured to be aligned with one of the bit compartments (5*a*–5*c*), respectively, for removal or insertion of the bit (2);

wherein the sleeve (8) has a length in the direction of the longitudinal axis (33) such that the upper end (9) and the lower end (10) form a continuous, uninterrupted ring, respectively.

2. A hand grip of a screwdriver for bits (2), the hand grip (1) comprising:

a grip member having a first end (1*a*) and a second end (1*b*) opposite the first end (1*a*);

the first end (1*a*) having a tool holder (3) configured to engage the bits (2);

the second end (1*b*) having a stationary core (4) with a round magazine (5) comprising bit compartments (5*a*–5*c*) configured to store the bits (2), wherein the bit compartments (5*a*–5*c*) extend in a direction of the longitudinal axis (33) of the second end (1*b*) of the grip member and are positioned adjacent to one another;

the second end (1*b*) having a closure device (6) configured to rotate relative to the stationary round magazine (5);

the closure device (6) comprising a sleeve (8) configured to provide an ergonomic outer shape of the second end (1*b*) of the grip member, wherein the sleeve (8) has an upper end (9) remote from the tool holder (3) and a lower end (10) proximal to the tool holder (3);

wherein the sleeve (8) is rotatably supported on the stationary core (4) and has an access opening (7) extending in the direction of the longitudinal axis (33);

wherein the access opening (7) passes externally across the bit compartments (5*a*–5*c*) when the sleeve (8) is rotated relative to the stationary core (4);

wherein the access opening (7) is configured to be aligned with one of the bit compartments (5*a*–5*c*), respectively, for removal or insertion of the bit (2);

wherein the sleeve (8) has a length in the direction of the longitudinal axis (33) such that the upper end (9) and the lower end (10) form a continuous, uninterrupted ring, respectively;

wherein the access opening (7) has a length (15) matching at least a length (14) of the bits (2).

3. The hand grip according to claim 1, wherein the upper end (9) and the lower end (10) have an outer contour (16) configured to be flush with an outer contour (17, 18) of adjoining parts of the grip member.

4. The hand grip according to claim 1, wherein the sleeve (8) has an inner contour (19) and the round magazine (5) has an outer contour (20), wherein the inner contour (19) is rotationally supported at least partially on the outer contour (20) of the round magazine (5).

5. A hand grip of a screwdriver for bits (2), the hand grip (1) comprising:

a grip member having a first end (1*a*) and a second end (1*b*) opposite the first end (1*a*);

the first end (1*a*) having a tool holder (3) configured to engage the bits (2);

the second end (1*b*) having a stationary core (4) with a round magazine (5) comprising bit compartments (5*a*–5*c*) configured to store the bits (2), wherein the bit compartments (5*a*–5*c*) extend in a direction of the longitudinal axis (33) of the second end (1*b*) of the grip member and are positioned adjacent to one another;

the second end (1*b*) having a closure device (6) configured to rotate relative to the stationary round magazine (5);

the closure device (6) comprising a sleeve (8) configured to provide an ergonomic outer shape of the second end (1*b*) of the grip member, wherein the sleeve (8) has an upper end (9) remote from the tool holder (3) and a lower end (10) proximal to the tool holder (3);

wherein the sleeve (8) is rotatably supported on the stationary core (4) and has an access opening (7) extending in the direction of the longitudinal axis (33);

wherein the access opening (7) passes externally across the bit compartments (5*a*–5*c*) when the sleeve (8) is rotated relative to the stationary core (4);

wherein the access opening (7) is configured to be aligned with one of the bit compartments (5*a*–5*c*), respectively, for removal or insertion of the bit (2);

wherein the sleeve (8) has a length in the direction of the longitudinal axis (33) such that the upper end (9) and the lower end (10) form a continuous, uninterrupted ring, respectively;

wherein the second end (1*b*) comprises an end member (22) configured to secure the sleeve (8) on the core (4), wherein the core (4) has a core end remote from the tool holder (3) and the end member (22) is anchored on the core end, wherein the upper end (9) of the sleeve (8) is located at a distance from the end face (21) of the second end (1*b*).

6. The hand grip according to claim 5, wherein the core (4) has a pressure-resistant stop (23) and wherein the end member (22) rests against the pressure-resistant stop (23) configured to receive pressure forces exerted by the ball of the thumb of a user.

7. The hand grip according to claim 5, wherein the end member (22) is secured on the core (4) so as not to rotate relative to the core (4).

8. The hand grip according to claim 7, wherein the end member (22) and the core (4) are secured on one another by a snap-on connector (25).

9. The hand grip according to claim 1, wherein the sleeve (8) comprises a position lock (26) configured to secure the sleeve (8) in an access position in which the access opening (7) is aligned with one of the bit compartments (5*a*–5*c*), respectively.

10. The hand grip according to claim 1, wherein the sleeve (8) is comprised of transparent plastic material.

11. The hand grip according to claim 1, wherein the grip member comprises a pivot joint (1*c*) located below the lower end (10) of the sleeve (8), wherein the pivot joint (1*c*) has a pivot axis (30) extending transversely to the longitudinal axis (33).

12. A hand grip of a screwdriver for bits (2), the hand grip (1) comprising:

a grip member having a first end (1*a*) and a second end (1*b*) opposite the first end (1*a*);

the first end (1*a*) having a tool holder (3) configured to engage the bits (2);

the second end (1*b*) having a stationary core (4) with a round magazine (5) comprising bit compartments (5*a*–5*c*) configured to store the bits (2), wherein the bit compartments (5*a*–5*c*) extend in a direction of the longitudinal axis (33) of the second end (1*b*) of the grip member and are positioned adjacent to one another;

the second end (1*b*) having a closure device (6) configured to rotate relative to the stationary round magazine (5);

the closure device (6) comprising a sleeve (8) configured to provide an ergonomic outer shape of the second end (1*b*) of the grip member, wherein the sleeve (8) has an upper end (9) remote from the tool holder (3) and a lower end (10) proximal to the tool holder (3);

wherein the sleeve (8) is rotatably supported on the stationary core (4) and has an access opening (7) extending in the direction of the longitudinal axis (33);

wherein the access opening (7) passes externally across the bit compartments (5*a*–5*c*) when the sleeve (8) is rotated relative to the stationary core (4);

wherein the access opening (7) is configured to be aligned with one of the bit compartments (5*a*–5*c*), respectively, for removal or insertion of the bit (2);

wherein the sleeve (8) has a length in the direction of the longitudinal axis (33) such that the upper end (9) and the lower end (10) form a continuous, uninterrupted ring, respectively;

wherein the grip member comprises a pivot joint (1*c*) located below the lower end (10) of the sleeve (8), wherein the pivot joint (1*c*) has a pivot axis (30) extending transversely to the longitudinal axis (33);

wherein the pivot joint (1*c*) divides the grip member into the first and second ends (1*a*, 1*b*), wherein the second end (1*b*) has extensions (31) projecting past the pivot joint (1*c*) toward the tool holder (3), wherein the extensions (31) are spaced apart in a direction of the pivot axis (30) and are located on opposite sides of the first end (1*a*) in an extended position of the grip member and form therebetween a receiving space for the thumb of a user in a pivoted position of the grip member.

13. The hand grip according to claim 1, wherein the first end (1*a*) comprises a ratchet mechanism (13) and wherein the tool holder (3) is received in the ratchet mechanism (13).

* * * * *